US011299299B2

(12) United States Patent
Conti

(10) Patent No.: US 11,299,299 B2
(45) Date of Patent: Apr. 12, 2022

(54) MACHINE AND PROCESS FOR MAKING PACKAGES CONTAINING LIQUID OR CREAMY PRODUCTS

(71) Applicant: CORAZZA S.p.A., Bologna (IT)

(72) Inventor: Roberto Conti, Imola (IT)

(73) Assignee: CORAZZA S.P.A., Bologna (IT)

( * ) Notice: Subject to any disclaimer, the term of this patent is extended or adjusted under 35 U.S.C. 154(b) by 282 days.

(21) Appl. No.: 16/468,869

(22) PCT Filed: Dec. 14, 2017

(86) PCT No.: PCT/IB2017/057920
§ 371 (c)(1),
(2) Date: Jun. 12, 2019

(87) PCT Pub. No.: WO2018/109697
PCT Pub. Date: Jun. 21, 2018

(65) Prior Publication Data

US 2020/0079534 A1 Mar. 12, 2020

(30) Foreign Application Priority Data

Dec. 15, 2016 (IT) ..... 102016000126510

(51) Int. Cl.
*B65B 43/00* (2006.01)
*B65B 3/02* (2006.01)
(Continued)

(52) U.S. Cl.
CPC ..... *B65B 3/027* (2013.01); *B65B 3/04* (2013.01); *B65B 39/12* (2013.01); *B65B 41/16* (2013.01); *B65B 43/10* (2013.01); *B65B 43/50* (2013.01)

(58) Field of Classification Search
CPC ..... B65B 3/04; B65B 43/00; B65B 43/10; B65D 5/606; B65D 5/2028; B65D 5/2042
See application file for complete search history.

(56) References Cited

U.S. PATENT DOCUMENTS 5,011,722 A * 4/1991 Chung ..... B65D 5/548 428/43
5,213,255 A * 5/1993 Cote ..... B65D 5/2042 229/115

(Continued)

FOREIGN PATENT DOCUMENTS

DE 19504045 A1 8/1996

OTHER PUBLICATIONS

International Search Report and Written Opinion dated Mar. 15, 2018 from counterpart PCT App No. PCT/IB2017/057920.

*Primary Examiner* — Chelsea E Stinson
(74) *Attorney, Agent, or Firm* — Shuttleworth & Ingersoll, PLC; Timothy Klima

(57) ABSTRACT

A machine for making packages containing liquid or creamy products includes stations for punching/forming a first blank defining upper, lower and rear faces of the open package. A punching and creasing station forms a second blank defining first and second lateral faces of the package. The second blank has a notch for partial transversal separation between the first and second lateral faces. A station for assembling the first blank with the second blank for opening/closing the package with the notch of the two lateral faces, arranged in a "V", to form an edge of the package. A transport unit is movable along a feed direction and configured to receive the package from the assembly station. A station opens the edge and fills the package with a dose of the product fed through the open notch. A station seals the notch.

16 Claims, 11 Drawing Sheets

(51) Int. Cl.

| | |
|---|---|
| ***B65B 3/04*** | (2006.01) |
| ***B65B 39/12*** | (2006.01) |
| ***B65B 41/16*** | (2006.01) |
| ***B65B 43/10*** | (2006.01) |
| ***B65B 43/50*** | (2006.01) |

(56) References Cited

U.S. PATENT DOCUMENTS

| | | | | |
|---|---|---|---|---|
| 6,360,941 | B1 * | 3/2002 | Larsson | B65D 5/2028 229/115 |
| 6,719,015 | B2 * | 4/2004 | Murray | B65B 3/04 141/10 |
| 2005/0229550 | A1 * | 10/2005 | Eder | B65B 3/04 53/571 |
| 2014/0033654 | A1 | 2/2014 | Stanley et al. | |

* cited by examiner

FIG.11
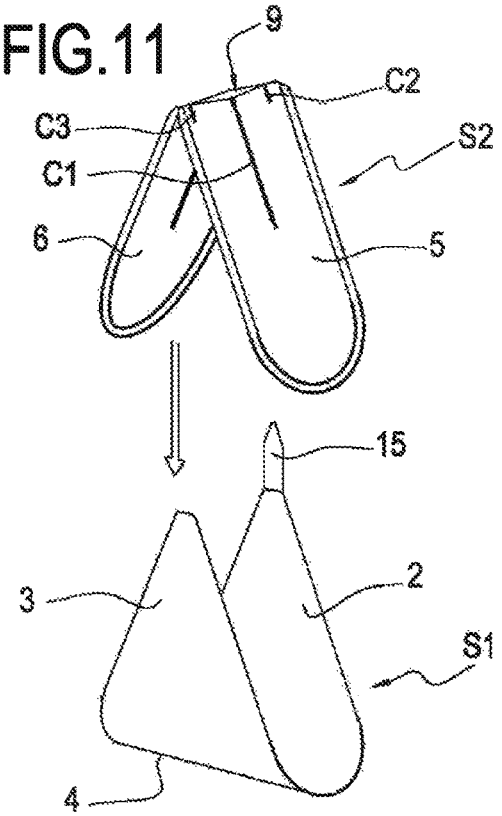
FIG.11a
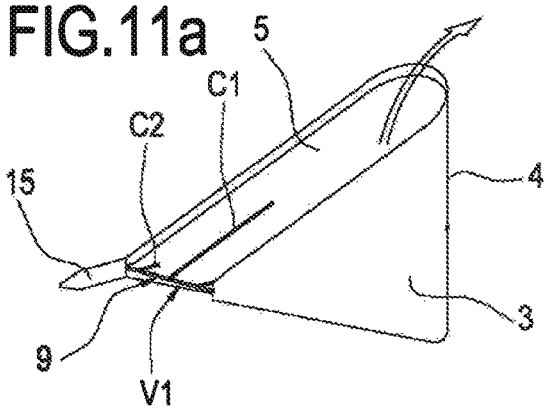
FIG.11c
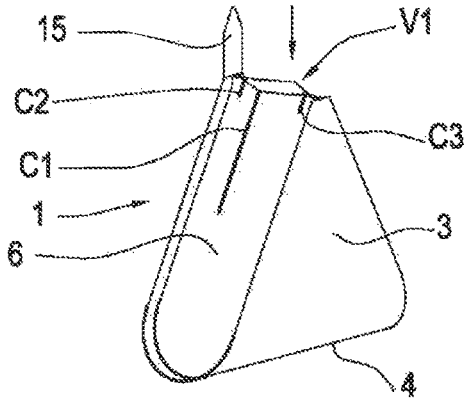
FIG.11b
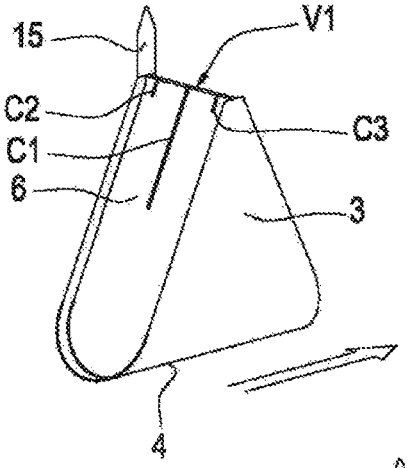
FIG.11e
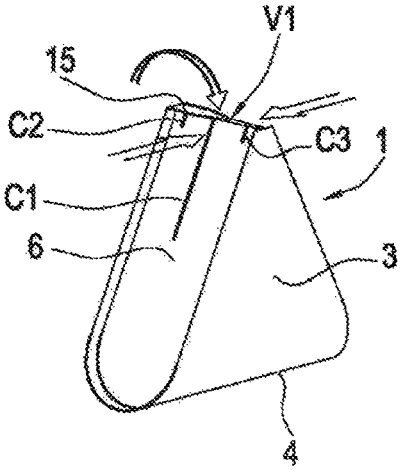
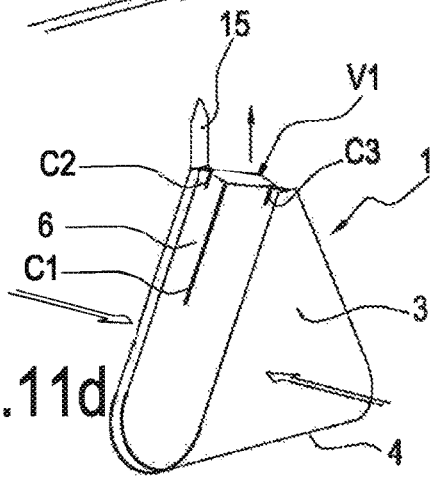
FIG.11d

MACHINE AND PROCESS FOR MAKING PACKAGES CONTAINING LIQUID OR CREAMY PRODUCTS

TECHNICAL FIELD

This application is the National Phase of International Application PCT/IB2017/057920 filed Dec. 14, 2017 which designated the U.S.

This application claims priority to Italian Patent Application No. 102016000126510 filed Dec. 15, 2016, which application is incorporated by reference herein.

This invention relates to a machine for making packages containing liquid or creamy products, for example of the food type.

The invention is also directed to a process for making packages containing the above-mentioned liquid or creamy products.

BACKGROUND ART

Reference is made in this description to a package with a triangular shape, in particular triangular prismatic in shape when the package is open and having five faces: an upper triangular face (the face which normally has a sticker for recognition of the product when the package is finished), a lower face, again triangular in shape, a rear face and two lateral faces for joining and connecting the upper and lower faces.

Again in this description, reference is made for liquid or creamy products to products which can be fed in the package by a nozzle, both when cold and when hot, such as, for example, consisting of processed cheese, butter, chocolate, marmalade, etc.

Currently, one of the known solutions for forming packages which are triangular prismatic in shape for the above-mentioned types of products uses sheets of aluminium and follows a series of steps as described below.

A first flat blank of the above-mentioned material is positioned above a hollow die which is triangular prismatic in shape and a punch shaped to match is inserted therein having a movement towards and away from the die.

Thanks to the movement of the punch, the blank is opened by deformation in order to conform to the inner walls of the die so as to form what will be the upper triangular face, the rear face and the two lateral faces of the triangular package.

The partial package thus obtained is then filled with product (preferably hot) from above, that is, through the opening present in the prismatic triangle, using a suitable dosing device.

It should be noted that, after the filling, the die may be subjected to a step of vibrating along a horizontal plane to allow a better distribution of the product in the package.

After the product is filled (together with any distribution of the product), a second flat blank or aluminium sheet (with a face equipped with heat sealing material), which is triangular in shape (defining the lower face of the finished product), is deposited on the still free triangular face of the package using an applicator device to close the package.

Subsequently, the free edges of the rear face and the two lateral faces of the blank are folded inwards, that is, towards the second sheet deposited.

Simultaneously with or immediately after folding the free edges, a sealing of the package is performed (using a presser/heating device) acting with a predetermined pressure on the second sheet, applied together with a heating designed to activate the heat sealing material on the inner surface of the second sheet in such a way as to join the folded edges with the second sheet.

As may be already inferred from the description of these steps, the machine making this type of package basically comprises:

- a station for feeding the first blank in flat form;
- a station for forming the above-mentioned four faces of the triangular prismatic package (comprising at least a die and a punch movable relative to each other);
- a station for dosing the product inside the partial package positioned inside the die;
- a station for feeding the second blank or flat aluminium sheet;
- a station for applying the second sheet on the free surface of the partial package positioned inside the die;
- a station for sealing the package having means for folding the edges of lateral and rear faces of the package and means for pressing and heat sealing the lower face with the edges of the lateral and rear faces.

A further station downstream of the sealing station is equipped with means for ejecting the sealed package from the die.

Now, the type of package and the relative method for making the package have several drawbacks.

The type of material used (aluminium sheets) and the particular geometric shape of the package determine a low sealing security against the passage of extraneous agents; in effect, the hot sealing of thin and flexible surfaces generates folds in the small passage ducts.

This factor considerably reduces the useful life of the package.

The type of material used for forming the package also has a very low mechanical strength threshold with high risks of accidental failure both during production and handling by the user.

In order to overcome these drawbacks, a package has been designed with the same prismatic triangular shape, consisting of: a first blank made of a material having a low deformability shaped to form the two triangular shaped upper and lower faces and the rear face when the package is assembled; a second blank forming the two lateral faces to be interposed between, and join, the lower face and the upper face and connecting the rear face when the package is assembled; more specifically, this second blank is shaped in the form of a 'V' during assembling to form an edge of the package.

This type of package, compared with the package made of aluminium, has: a greater mechanical strength; reduced risk of breaking during handling; greater versatility, as it may be filled either with hot or cold products.

This type is of package is made using the following steps: assembling (for example by heat sealing) between the first blank and the second blank (carried in the form of a 'V') at least along the sides of the lower triangular face and at the ends of the rear face; the upper triangular face is moved or kept in a configuration away from the lateral faces (that is, positioned transversally to the lower face) to define an upper opening; dosing of the product from above and inside the space formed by the rear face, lateral faces and lower face; rotation and joining of the upper face on the lateral faces.

A machine to obtain this type of package basically comprises:

- a station for partial joining of the first blank with the second blank in the manner mentioned above;
- a station for dosing the product, from above, inside the package open on the upper face (upper face held in raised position, of non-interference);

a station for sealing the package by folding and sealing the upper face on the lateral faces and, partly, on the rear face.

However, this type of process and the machine are not free from drawbacks.

More specifically, the step of filling the product through a large open surface means that the contents have a significant percentage of air even after the sealing step so as not to be able to guarantee a long life before the expiry date of the product; again, the filling step performed in this way does not guarantee a correct uniform distribution of the product in the open package; the step of sealing a face with a large surface affected by the sealing, that is, on the lateral faces and, in part, on the rear face, might not guarantee a secure seal against external agents.

These drawbacks are reflected on machine for making the packages, in particular on the dosing and sealing stations which require large dimensions in order to be able to place one or more packages side by side along a horizontal plane so as to obtain high productivity per unit time.

DISCLOSURE OF THE INVENTION

The aim of this invention is to provide a machine for production of packages containing products, preferably liquid or creamy food products, which overcome the above-mentioned drawbacks of the prior art.

Another aim of this invention is to provide a process for making packages containing products, preferably liquid or creamy food products, which overcome the above-mentioned drawbacks of the prior art.

More specifically, the aim of this invention is to provide a machine and a process for making packages containing products, preferably liquid or creamy food products, which can increase the productivity of packages per unit time and, at the same time, reduce the overall dimensions of the machine.

A further aim of this invention is to provide a machine and a method for making packages containing products, preferably liquid or creamy food products, capable of obtaining packages of high quality and closing security and with reduced percentages of air in contact with the product to guarantee a long life of the packaged product.

These aims are fully achieved by the machine and process for making packages containing products, preferably liquid or creamy food products, according to this invention, as characterised in the appended claims.

More specifically, the machine for making packages containing products, preferably liquid or creamy food products, for example processed cheese, forms a package which is prismatic triangular in shape, when open, having an upper face and a lower face which are triangular in shape, a rear face and a first and a second lateral face for joining and connecting the upper and lower faces.

According to the invention, the machine comprises a station for punching and forming a first flat blank defining the upper face, the lower face and the rear face when the package is open.

Also according to the invention, the machine comprises a station for punching and creasing for the formation of a second flat blank defining the first and the second lateral face of the package, when the package is opened; the second blank has at least one notch of partial transversal separation between the first and the second lateral face. In other words, the punching and creasing station comprises punching or cutting means for making the notch on the second blank.

Also according to the invention, the machine comprises a station for assembly of the first blank with the second blank to obtain the opening and closing of the package with the notch of the two lateral faces, arranged in the form of a "V", to form an edge of the open package.

Also according to the invention, the machine comprises a transport unit, which is movable along a feed direction, and configured to receive the package from the assembly station and (subsequently) position the open package with its edge perpendicular to the feed direction, at least along an operating section of the transport unit.

Also according to the invention, the machine comprises a station for opening the edge (that is, the notch) of the open package and filling the package with a dose of product fed through the open edge of the package; this opening and filling station is positioned along the operating section of the transport unit.

Also according to the invention, the machine comprises a station for sealing the edge (that is, the notch) of the package opened and filled with the product; the sealing station is positioned downstream of the opening and filling station with respect to a feed direction of the packages along the feed direction.

Thanks to a machine structured in this way the package is assembled quickly and in reduced spaces.

The possibility of filling the package already assembled and through the edge of the package guarantees a fast, precise and safe filling, avoiding, at the same time, dispersion of the product. To this must be added the reduction of dimensions of the station (therefore of the machine) thanks to the specific arrangement of the package being processed along the operating section.

The final sealing of just the edge of the package guarantees a high overall seal of the package and allows long-term expiry dates of the product.

Preferably, one of the upper or lower faces has a tab projecting from the edge of the open package. Again preferably, the machine comprises a station for folding and adhesion of the tab on the edge of the open and sealed package.

Again preferably, the folding and adhesion station is positioned downstream of the sealing station relative to the feed direction of the packages along the feed direction.

Thanks to this station for folding and adhesion of the tab, use is made of an operation for reducing the dimensions of the package for further improving the closing of the edge (that is, of the notch) of the package.

Preferably, the sealing station also comprises means for pushing both sides operating on the upper and lower face or on the lateral faces of the open package and able to remove air through the opening of the edge before its sealing.

More specifically, the package is partly flattened in the part furthest away from the edge for varying (reducing) the containment space of the package and obtaining a removal/moving away of the air present inside the containment space of the package: this makes it possible to maintain the organoleptic properties of the packaged product for a longer period of time and therefore with longer expiry periods.

BRIEF DESCRIPTION OF THE DRAWINGS

These and other features of the invention will become more apparent from the following detailed description of a preferred, non-limiting embodiment of it, with reference to the accompanying drawings, in which:

FIGS. 11, 11*a*, 11*b*, 11*c*, 11*d* and 11*e* illustrate perspective views of a series of schematic steps of the process for forming the package actuated by the machine of FIGS. 1 to 10;

DETAILED DESCRIPTION OF PREFERRED EMBODIMENTS OF THE INVENTION

Figure 1:
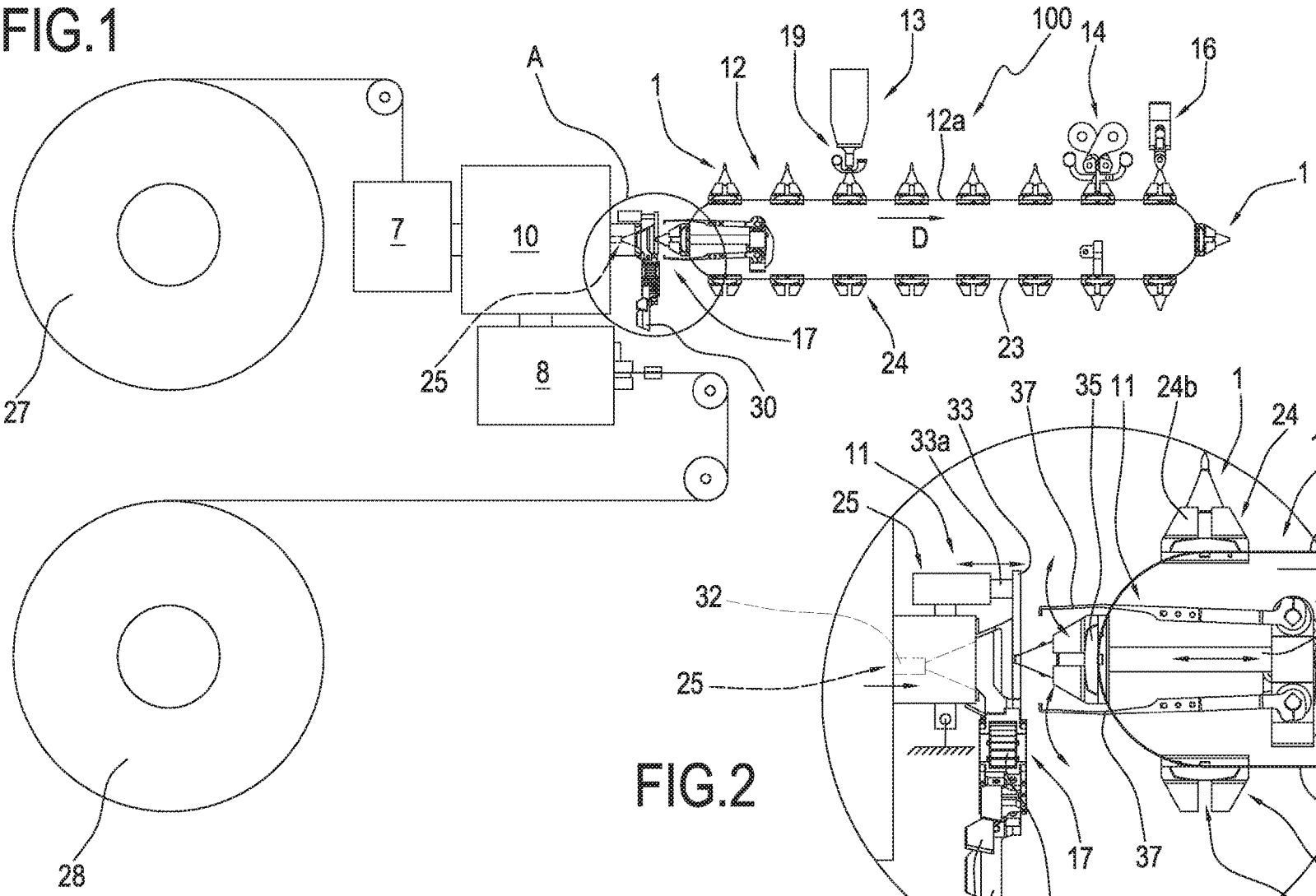
FIG. 1 illustrates a schematic side view, with some parts removed to better illustrate others, of a machine for making packages containing products, preferably liquid or creamy food products, and performing the packaging process, according to this invention.

With reference to the accompanying drawings, and with particular reference to FIGS. 1 and 11, the machine according to the invention, labelled 100 in its entirety, is designed for making packages 1 containing products, preferably liquid or creamy food products.

Examples of liquid or creamy products are processed cheese portions, butter, chocolate, marmalade, etc., which can be fed into the package both when cold and when hot.

The package 1, made with the machine 100 according to this invention, has a prismatic triangular shape (see FIG. 11) when the package 1 is open.

The package has an upper face 2 and a lower face 3 with a triangular shape, a rear face 4 and a first 5 and second 6 lateral face for joining and connecting the upper 2 and lower 3 faces. The first 5 and the second 6 lateral face form an edge V1.

Preferably, one of the upper 2 or lower 3 faces has a tab 15 projecting from the edge V1 of the open package 1 (the edge being described more clearly below).

According to this invention, the machine 100 comprises a station 7 for punching and forming a first flat blank S1 defining the upper face 2, the lower face 3 and the rear face 4 when the package 1 is open (see FIG. 11).

Also according to the invention, the machine 100 comprises a station 8 for punching and creasing for the formation of a second flat blank S2 defining the first 5 and the second 6 lateral face of the package 1, when the package 1 is opened (see FIGS. 1 and 11).

According to the invention, the second blank S2 has at least one notch, or slot, or slit, 9 for partial transversal separation between the first 5 and the second 6 lateral face.

Also according to the invention, the machine 100 comprises a station 10 for assembling the first blank S1 with the second blank S2 to obtain the opening and closing of the package 1 with the above-mentioned at least one notch 9 of the two lateral faces 5 and 6 positioned in the form of a "V", on the (forming the) edge V1 of the open package 1.

Also according to the invention, the machine 100 comprises a transport unit 12, which is movable along a feed direction D, and configured to receive the package 1 from the assembly station 10 and position the open package 1 with its edge V1 perpendicular to the feed direction D, at least along its operating section 12*a*.

Also according to the invention, the machine 100 comprises a station 13 for opening the edge V1 (that is, the notch 9) of the open package 1 and filling the package 1 with a dose of product fed through the open edge V1 of the package 1.

This opening and filling station 13 is positioned along the operating section 12*a* of the transport unit 12.

Also according to the invention, the machine 100 comprises a station 14 for sealing the edge V1 (that is, the notch 9) of the open package 1 filled with the product.

In addition, the sealing station 14 may also comprise means for sealing only the opposite ends of the edge V1, at the sides of the notch 9, with the upper face 2 and lower face 3 of the package 1.

This sealing station 14 is positioned downstream of the opening and filling station 13 with reference to the feed direction D and to the feed direction of the packages 1.

Preferably, the machine 100 also comprises a station 16 for folding and adhesion of the above-mentioned tab 15 on the edge V1 of the open and sealed package 1.

In light of this, the folding and adhesion station 16 is positioned downstream of the sealing station 14 with reference to the feed direction D and the feed direction of the packages 1.

Alternatively, the folding and adhesion station 16 can be positioned together with the sealing station 14.

Again preferably, the machine 100 comprises an intermediate station 17 for composing a row of open packages 1, alongside each other along a direction transversal to the feed direction D, and formed by the assembly station 10.

It should be noted that the intermediate station 17 is interposed between the assembly station 10 and the transport unit 12 and configured to receive, in a synchronised fashion, the individual open packages 1 and release, again in a synchronised fashion, a row of open packages 1 to the transport unit 12.

Preferably, the machine 100 also comprises means 11 for transferring the packages 1 positioned between the assembling station 10 and the transport unit 12.

In light of this, the transfer means 11 comprise (are divided into):

- for means 25 for transferring and individual package 1 formed in the assembly station 10 to the intermediate station 17 for composing a row of open packages 1, and
- second means 26 for simultaneously transferring a plurality of open packages 1, forming the row, from the station intermediate 17 on the transport unit 12.

Again preferably, the machine 100 comprises an unloading station downstream (with reference to the feed direction D and the feed direction of the packages 1) of the folding and adhesion station 16, wherein the packages 1 are expelled from the transport unit 12 for being conveyed to the packaging.

As mentioned above, the package 1 is formed by assembling two different blanks S1 and S2.

The first blank S1 is made in the punching station 7 (represented schematically), comprising a reel 27 for feeding a continuous strip of material to be punched towards the punching station 7.

In light of this, the punching station 7 is equipped with a punch and a die (not illustrated) shaped in order to make, in a plane, the first blank S1 (shown in FIG. 11) which will define the upper face 2, the lower face 3 and the rear face 4 when the package 1 is assembled and opened.

The station 7 is equipped with means for feeding the first blanks S1 to the assembly station 10.

The second blank S2 is made in the punching and creasing station 8, comprising a corresponding reel 28 for feeding a continuous strip of material to be punched and creased (made of the same material as the first blank, or different material) towards the punching and creasing station 8.

It should be noted that the punching and creasing station 8 is equipped with a punch and die unit (not illustrated) configured for forming the second flat blank S2 defining the first 5 and the second 6 lateral face of the package 1, when the package 1 is open (see FIG. 11).

In light of this, the punch and die unit is equipped with suitable means for forming on the second blank S2 at least one notch 9 for partial transversal separation between the first 5 and the second 6 lateral face (when opened).

As well as the notch 9, the second blank S2 may advantageously comprise a pair of first longitudinal creases C1, positioned one on the first lateral face 5 and one on the second lateral face 6. The first longitudinal creases C1 originate from the notch 9 and are transversal to it. Advantageously, the first longitudinal creases C1 intersect the notch 9 at a mid-point of the notch 9.

The first longitudinal creases C1 are advantageously parallel to the longitudinal axis of extension of the blank S2 in the flat form.

The notch 9 can advantageously be made together with the first longitudinal creases C1 in the punching and creasing station 8.

The first longitudinal creases C1 favour the opening of the notch 9, in particular in the shape of a rhombus.

Advantageously, the second blank S2 comprises two further pairs of longitudinal creases, that is, a second pair C2 and a third pair C3 of longitudinal creases, advantageously parallel to the first pair of longitudinal creases C1. The further pairs of longitudinal creases (C2, C3) are positioned at the end of the notch 9, perpendicularly to the notch 9, and further favour the opening of the notch 9.

Therefore, in the embodiment illustrated, each lateral face (first 5 and second 6) comprises a first C1, a second C2 and a third C3 longitudinal crease, the first crease C1 being positioned between the second C2 and the third C3 longitudinal crease.

In short, the (pairs of) creases C1, C2 and C3 determine fold lines which favour the folding of the material of the second blank S2, in such a way as favour the opening of the notch 9 (as described in more detail below).

In alternative embodiments, as a function of the material of the second blank S2, the creases may be reduced to one (for example, the longitudinal creases C2 and C3 may be omitted), and they may also have dimensions and shape different from the one illustrated, or they may be increased in number.

The punching and creasing station 8 is equipped with corresponding means (not illustrated) for feeding the second blanks S2 to the assembly station 10, for feeding the second blanks S2, in a synchronised fashion with the first blanks S1, to the assembly station 10.

It should be noted that the means for feeding the second blanks S2 feed the second blanks S2 in a receiving zone of the assembly station 10 different from the receiving zone of the assembly station 10 wherein the first blanks S1 are fed by the first feeding means.

Preferably, the assembly station 10 is configured to separately receive the two blanks S1 and S2, and to manipulate and assemble (seal) together the two blanks S1 and S2 in such a way as to form and open the package 1 in its triangular prismatic configuration.

Figure 2:
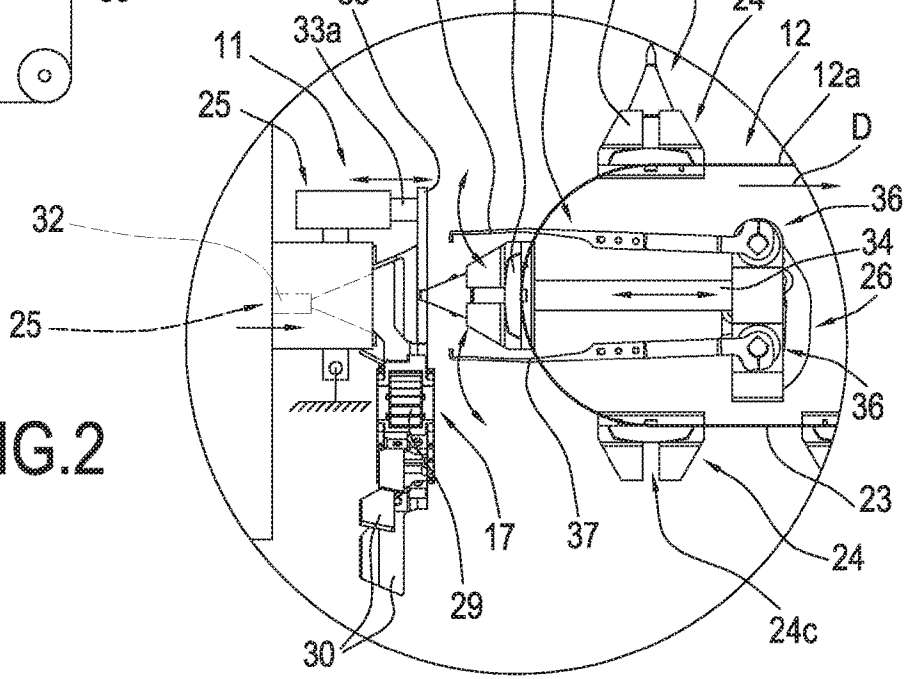
FIG. 2 illustrates a detail A in enlarged scale of an intermediate station of the machine of FIG. 1.

Preferably, the assembly station 10 has a zone for expulsion of the assembled package 1 positioned in the vicinity of the above-mentioned intermediate station 17 (see FIGS. 1 and 2).

It should be noted that the intermediate station 17 comprises a belt 29 of the closed-loop type around two pulleys, of which at least one motorised.

It should be noted that the belt 29 has an upper active section having an extension transversal to the feed direction D of the transport unit 12.

Figure 3:
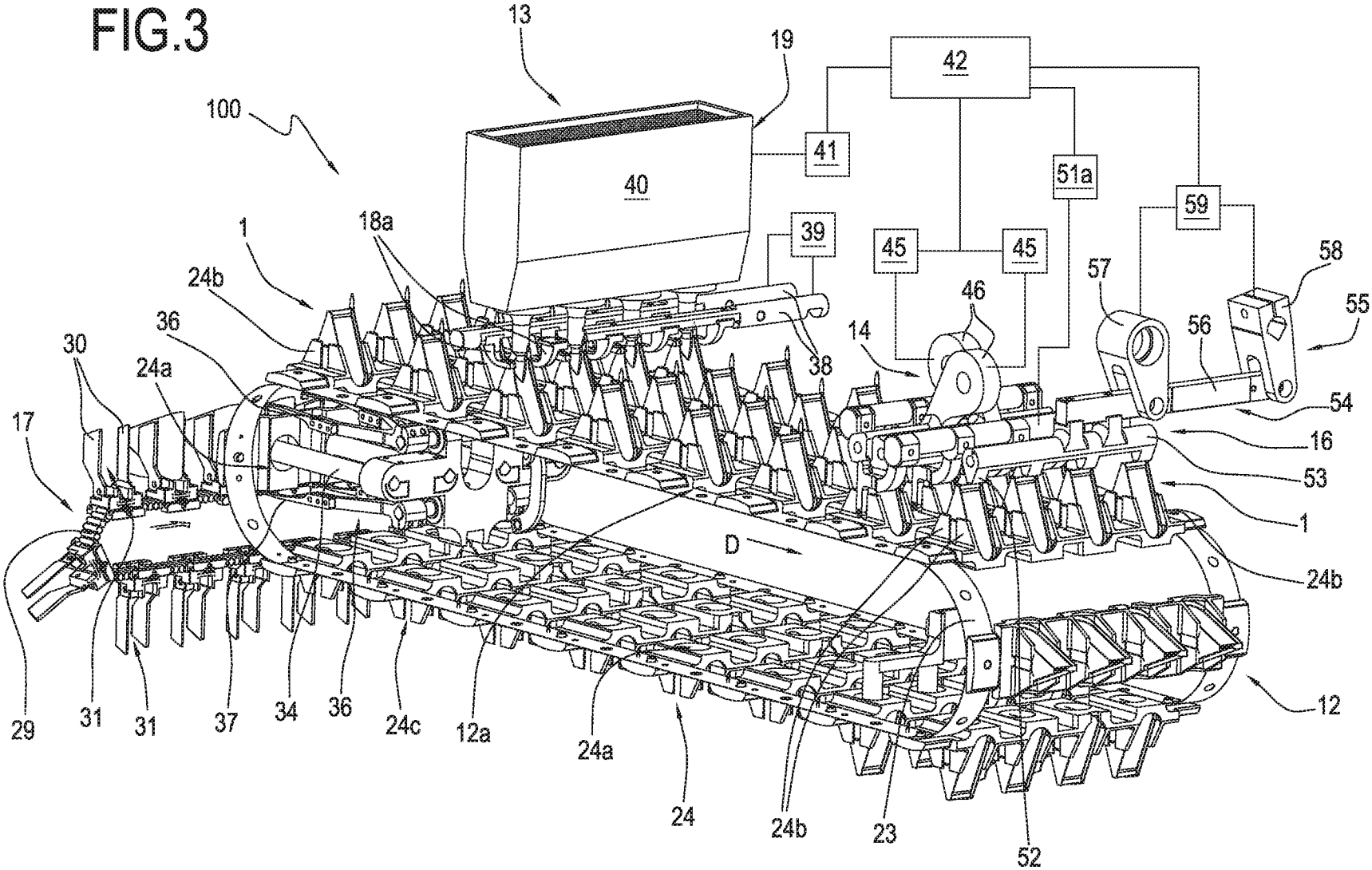
FIG. 3 illustrates a rear perspective view with some parts cut away to better illustrate others of a unit for transporting the packages and a set of operating stations for forming the package forming part of the machine of FIG. 1.

In light of this, the belt 29 is equipped along the relative extension with a plurality of pairs of tabs 30 protruding radially towards the outside of the belt 29 (see also FIG. 3).

Each pair of tabs 30 defines a compartment 31 in which it is possible to house a corresponding package 1 at the outfeed from the assembly station 10, when a corresponding pair of tabs 30 faces the expulsion zone of the assembly station 10.

More specifically, the outfeed zone of the assembly station 10 is located close to an end of the active section of the belt 29.

Preferably, in the outfeed zone of the assembly station 10 there are the first transfer means 25 (forming part of the transfer means 11) for transferring a single package 1 formed in the assembly station 10 to the belt 29 for composition of a row of open packages 1.

Described below is a preferred embodiment of the machine 100 having a series of rows of four packages 1 side by side, but that only by way of a non-limiting example of the validity of the invention. Generally speaking, a machine 100 according to the invention comprises n rows of packages 1, the numeral n being greater than or equal to 1.

Preferably, these first transfer means 25 comprise an expulsion element 32 positioned in the assembly station 10 and a contact plate 33 positioned between the assembly station 10 and the belt 29.

In light of this, the expulsion element 32 is in contact with, and pushes on, the edge V1 of the open package 1 (along a horizontal direction parallel to the feed direction D), whilst the plate 33 comes into contact with the rear face 4 of the open package 1 and moves towards the belt 29 synchronised with the pushing of the expulsion element 32.

It should be noted that the expulsion element 32 and the plate 33 maintain a constant contact on both sides to allow a transfer of the open package 1 from the assembly station 10 until insertion of the package 1 in the compartment 31 formed by a pair of tabs 30.

In light of this, the plate 33 is connected to an actuator 33*a* which is able to move the plate 33, in a synchronised fashion with the expulsion element 32, between a first retracted end position of contact with the rear face 4 of the package 1 and a second forward end position for movement away from the rear wall 4 with the package 1 housed in the compartment 31 and in the direction of the transport unit 12 (again, see FIG. 2).

It should be noted that the plate 33 returns to the first retracted end position after the movement for feeding the belt 29 along the direction transversal to the feed direction D to bring a subsequent pair of free tabs 30 in the unloading zone.

Preferably, this transferring of the open packages 1 allows a row of packages 1 to be formed on the operating section of the belt 29.

The row of packages 1 formed on the active section of the belt 29 is transferred on the transport unit 12 using the above-mentioned second transfer means 26 simultaneously with a plurality of open packages 1, forming the row, on the transport unit 12.

It should be noted that the row of packages 1 formed on the transport unit 12 extends transversally relative to the feed direction D of the transport unit 12.

Preferably, the transport unit 12 comprises a belt 23 closed in a loop and moved by drive units not illustrated. The upper section formed by the ring of the belt 23 defines the above-mentioned active section 12*a* passing below the above-mentioned stations for opening and filling, sealing, and folding and adhesion of the tab 15 (see FIGS. 1 to 3).

The belt 23 has at least one cradle 24 for retaining and housing the open package 1.

In the embodiment illustrated, the belt 23 has a plurality of cellular cradles 24 divided in a series of rows arranged in succession one after the other and transversely to the feed direction D. In this example, each row present consists of a series of four cradles 24.

Each cradle 24 has three walls encircling at least the rear face 4 and a part of the upper 2 and lower face.

In light of this, the bottom wall of the cradle 24 has a central hole 24*a* (the purpose of which is described in more detail below) and two lateral walls 24*b*.

The two lateral walls 24*b* of each cradle 24 each have a trapezoidal shape, with larger base joined with the bottom wall. In the central zone of each lateral wall 24*b* a through channel 24*c* is made which divides into two half parts the corresponding lateral wall 24*b* and the purpose will be described in detail below.

The above-mentioned second transfer means 26 are positioned within the dimensions of the belt 23 and close to the arc formed by the belt 23 close to the belt 29 for forming the row of packages 1.

In light of this, the second transfer means 26 comprise an actuator 34 having a gripping head 35, at it free end, for picking up the package 1 at the rear face 4.

Preferably, the actuator 34 moves the gripping head 35 between a forward operating position for gripping the package 1 located in the compartment 31 defined by the tabs 30 and a withdrawn operating position for releasing the package 1 inside the cradle 24.

The actuator 34 moves parallel to the feed direction D and, together with the head 35, may reach the package 1 and release it in the cradle 24 passing through the through hole 24*a* present on the bottom of the cradle 24.

Preferably, the gripping head 35 has a profile shaped to match at least the outside shape of the rear face 4 of the package 1 for correctly gripping the package 1.

Again preferably, the second transfer means 26 also comprise gripper means 36 with arms 37 for picking up both sides of the connecting zones between the rear face 4 and the two lateral faces 5 and 6 of the package.

In light of this, the gripper means 36 have the arms 37 positioned on opposite sides to the actuator 34. Each arm 37 has a spout curved in the direction of the actuator 34 for retaining the corresponding zone of the package 1 during the movement for transferring the package 1 from the compartment 31 to the cradle 24.

In other words, each arm 37 can be rotated to and from the package 1 in synchronised fashion with the actuator 34 to obtain a stabilisation of the position of the package 1 during the transfer movement: stabilising obtained by three points of contact on the rear part of the package 1.

In the embodiment illustrated, for each series of cradles 24 forming one row there is a unit comprising an actuator 34 with head 35 and a gripper unit 36.

As must be seen in FIGS. 1 to 3, when one row of packages 1 is finished, that is, when a predetermined series of packages 1, transferred individually and in succession in corresponding compartments 31 which gradually position themselves (individually) in front of the expulsion zone of the assembly station 10, are moved transversally from the belt 29 in such a way as to be positioned facing the corresponding cradle 24 waiting, the second transfer means 26 are activated simultaneously for transferring the packages 1, forming the row, from the compartments 31 to the cradles 24.

It should be noted that after the transfer of the packages 1 in the cradles 24 to form the row, the belt 23 moves carrying the packages 1 along the operating section 12*a* and arranging them with the edge V1 perpendicular to the feed direction D.

Above the operating section 12*a* of the belt 12 there is the above-mentioned station 13 for opening and filling the package 1.

Preferably, the opening and filling station 13 comprises means 18 for flattening on both sides the open package 1.

Figure 4:
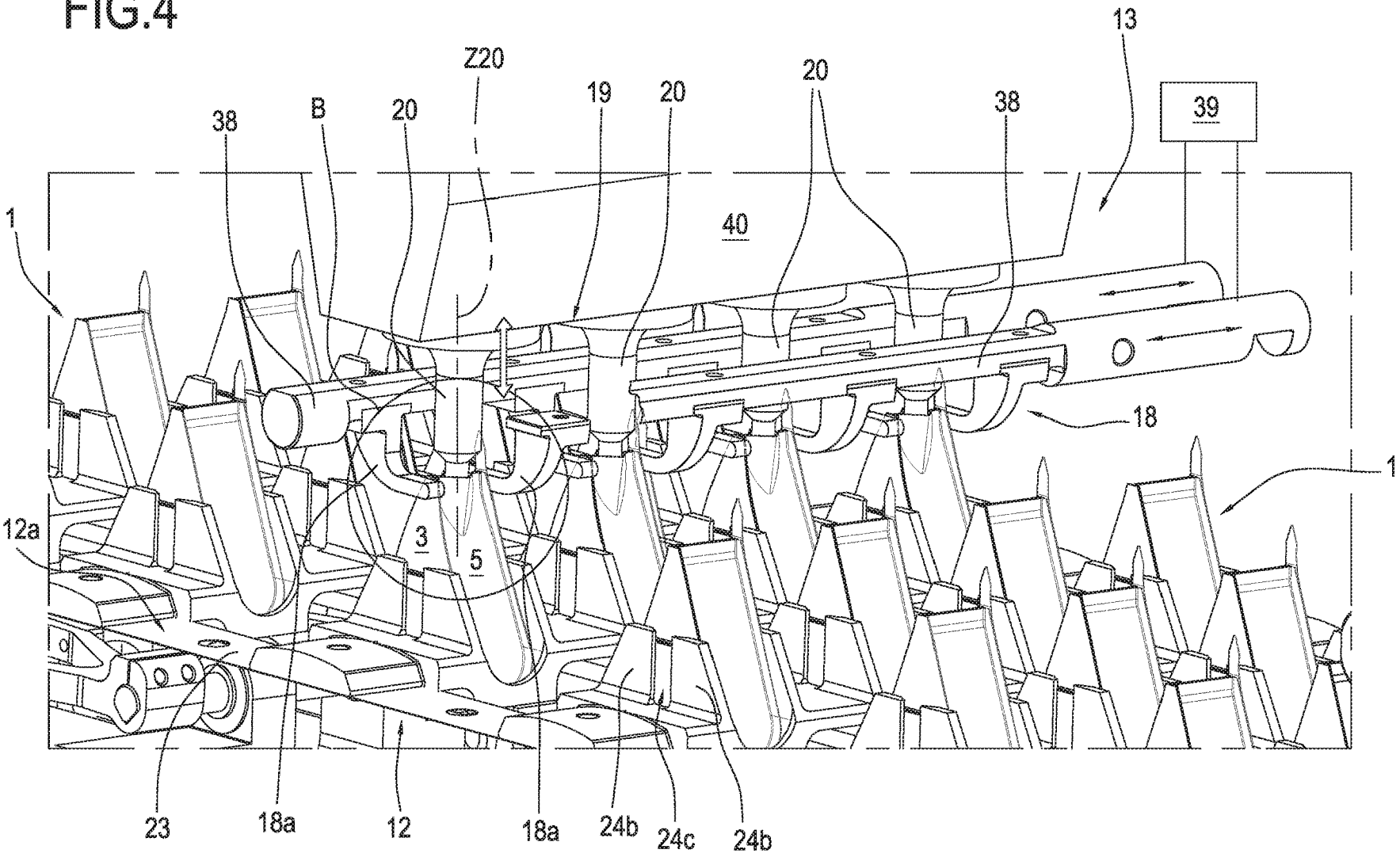
FIG. 4 illustrates a perspective view of a detail of station for opening and filling the package forming part of the machine according to this invention.
Figure 5:
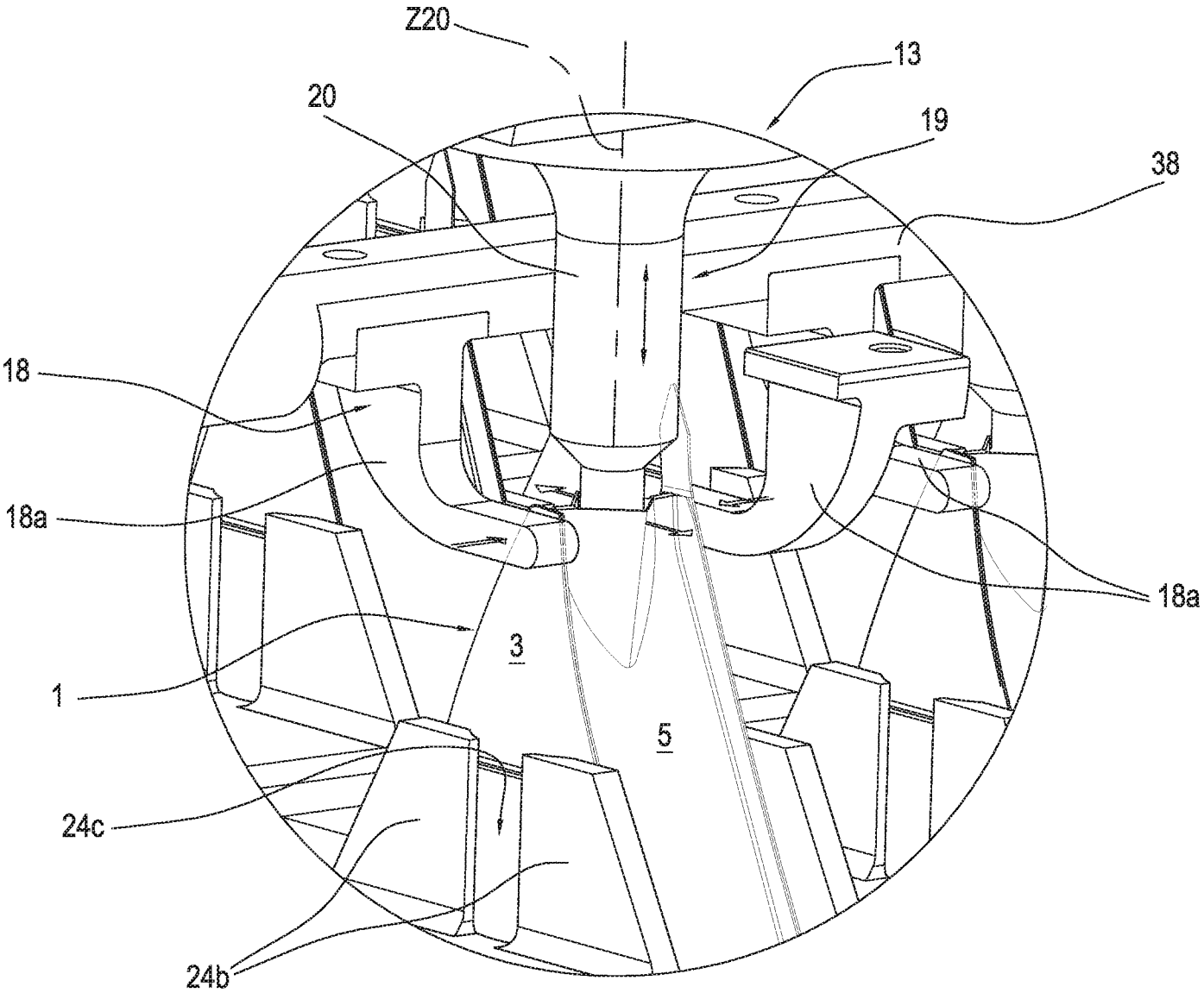
FIG. 5 illustrates a detail B referred to FIG. 4.
Figure 6:
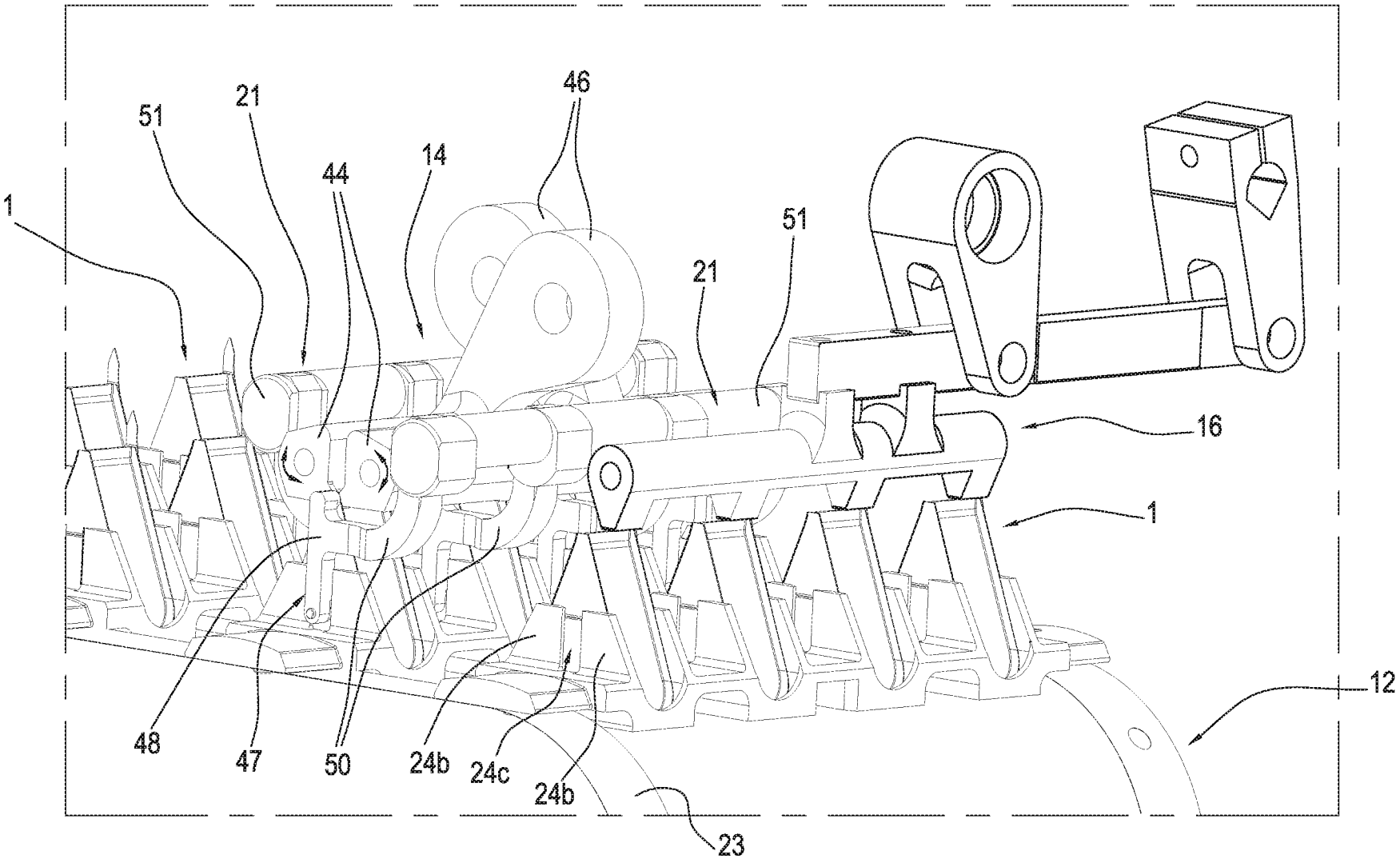
FIG. 6 illustrates a perspective view of a part of the machine comprising the transport unit of FIG. 3 and stations for sealing the package and folding and adhesion of a tab of the package.
Figure 7:
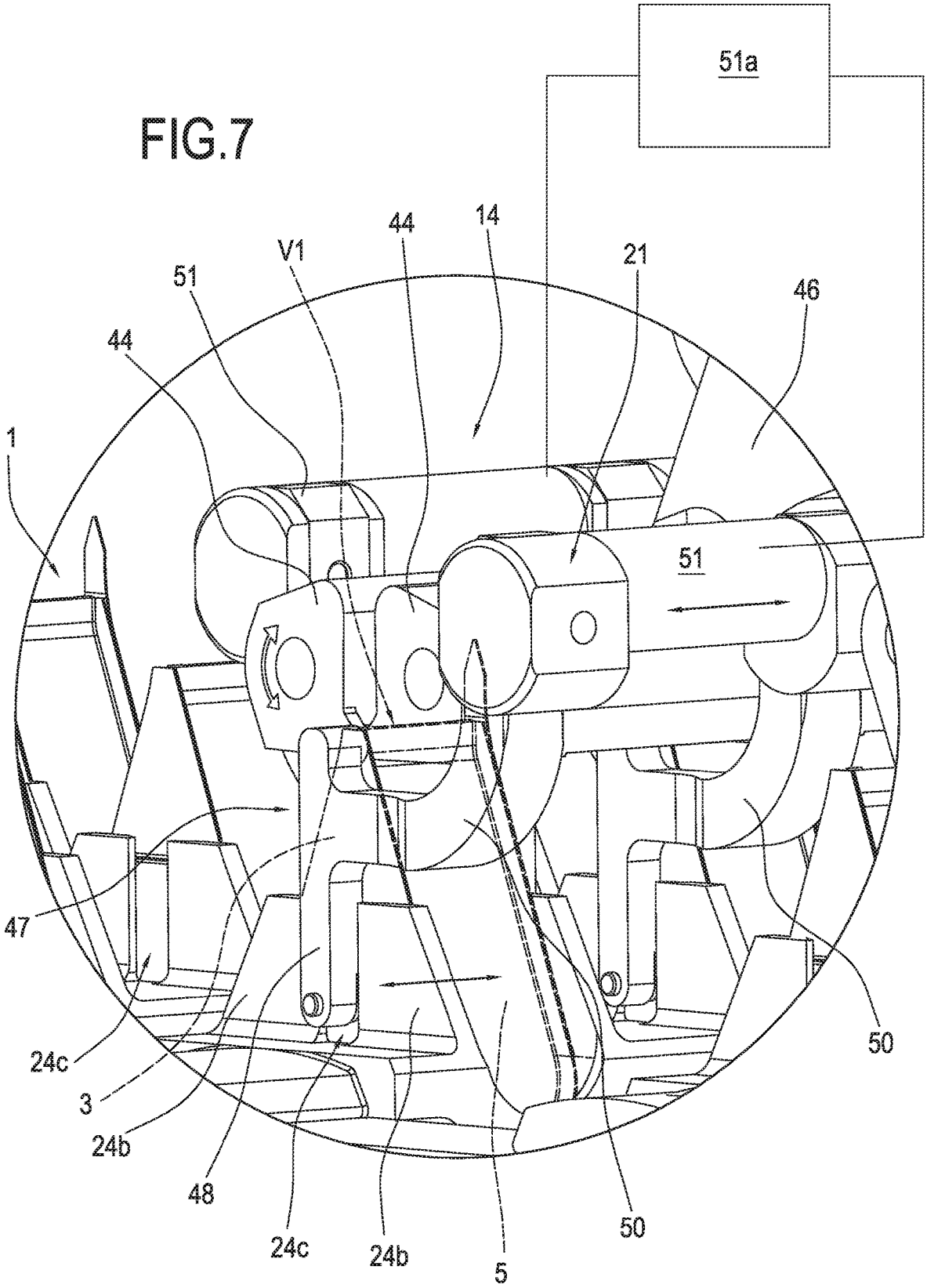
FIGS. 7 and 8 both illustrate a perspective view with some parts cut away to better illustrate others of a detail of the station for sealing the package.
Figure 8:
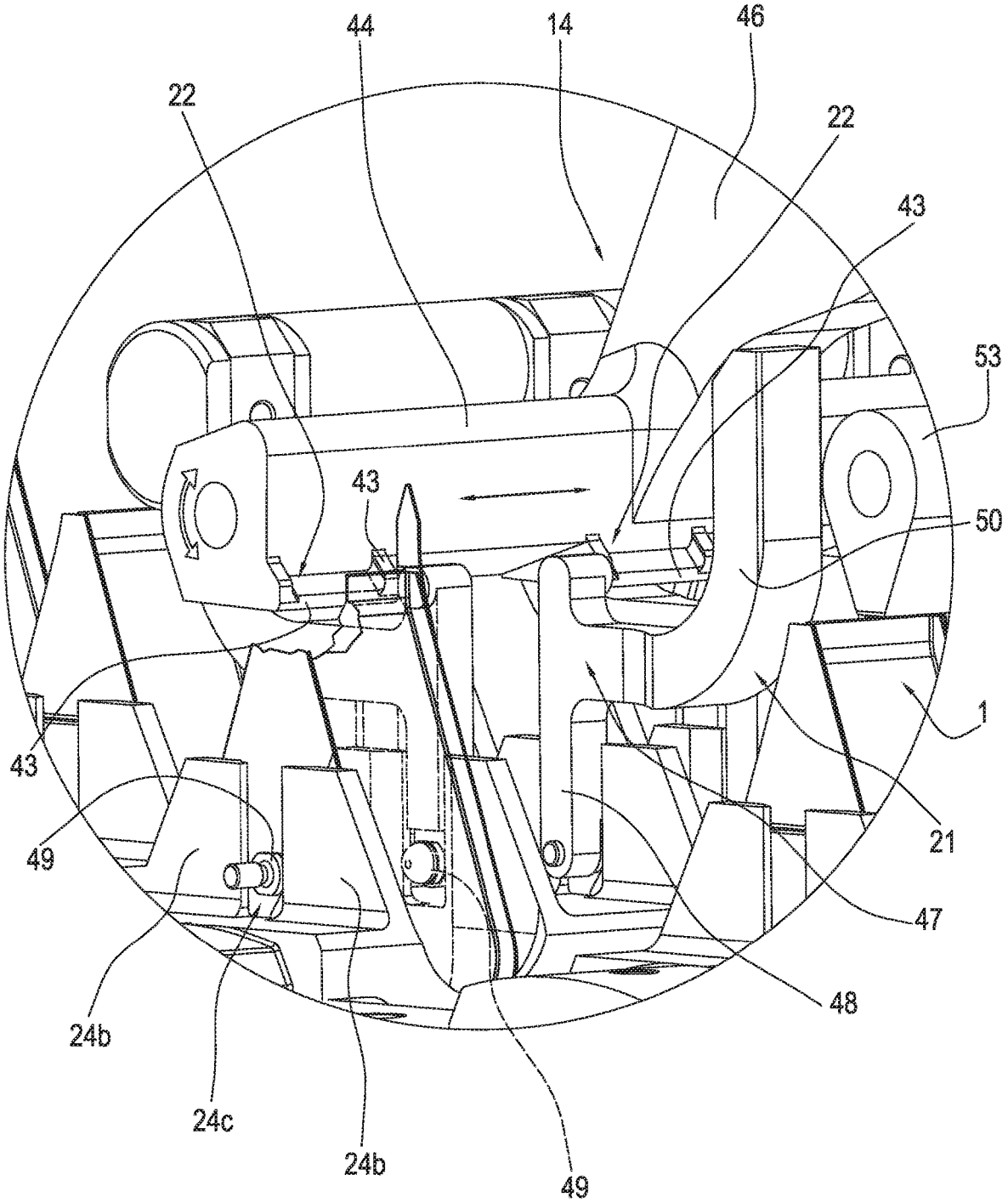

In light of this, the flattening means 18 are operatively positioned on opposite sides of the package 1 (positioned in the cradle 24) and able to elastically deform the edge V1 of the open package 1, that is to say, the zone of the package 1 affected by the notch 9, to form an opening for passage of the product (see FIGS. 3 to 5).

Preferably, these flattening means 18 comprise a pair of arms 18*a* positioned at a certain height and on opposite sides at each edge V1 of the corresponding open package 1.

In light of this, each arm 18*a* is associated with a corresponding shaft 38 positioned transversally to the feed direction D.

It should be noted that each arm 18*a* (L-shaped) protrudes from the corresponding shaft 38 and extends parallel to the feed direction D in such a way as to be alongside the edge V1 of the packages 1 in transit.

The pair of shafts 38, parallel to each other, have a respective actuator 39 (illustrated schematically in FIG. 4) for transferring the relative arms 38 between a first non-operating position away from the edge V1 of the package 1 and a second operating position in contact with the edge V1 of the package 1.

The actuators 39 of the shafts 38 are configured for moving the corresponding arms 18*a* in opposite directions to actuate a pressure, or a flattening, on the edge V1 of the package 1, thereby obtaining the opening of the edge V1 thanks to the presence of the notch 9. The creases C1, C2 and C3 which originate from the edge V1 favour the opening of the notch 9.

More specifically, the pressure generated by the arms 18*a* allows the deformation of the central zone of the notch 9 (creating an opening of the edge V1 with a substantially rhomboid cross section).

In the embodiment illustrated, each shaft 38 supports four arms 18*a* positioned alongside the relative package 1 in transit on the operating section 12*a* of the belt 12.

Preferably, the opening and filling station 13 also comprises a feeding unit 19 having at least one nozzle 20 for dosing the product.

Preferably, the nozzle 20 is associated with a hopper 40 for containing the food product for the nozzle 20.

In a first embodiment, the nozzle 20 is movable, in both directions, along a vertical axis Z20 at least between a first lowered end operating position, wherein the nozzle 20 is positioned inside the open package 1 and passing through the opening of the edge V1, and a second raised non-operating end position, wherein the nozzle 20 is positioned above the package 1 in a configuration of non-interference with the package 1.

In an alternative embodiment, the nozzle 20 and the hopper 40 for containing the food product are connected as one to means 41 for moving upwards to actuate together the movement in height between the lowered position and raised end operating positions.

It should be noted that the nozzle 20 is connected to a control unit 42 which determines the speed and the quantity of product dispensed into the package 1 correlated to the position in height of the nozzle 20, in such a way as to uniformly distribute the product inside the package 1.

In other words, the product can be dispensed with greater outfeed speed close to the bottom face 4 of the package 1 (greater inner space) and then gradually reduce as the nozzle 20 rises towards the edge V1 of the package 1 (reducing inner space).

Thanks to this feature and the particular configuration for dispensing through the opening of edge V1, the filling is very fast and extremely precise.

In the embodiment illustrated, again by way of example, the hopper 40 simultaneously feeds four nozzles 20 movable in synchronised fashion for simultaneously feeding the package 1 of a same row.

Downstream of the opening and filling station 13, relative to the feed direction D and the feed direction of the packages 1, there is the sealing station 14 (see in particular FIGS. 3 and from 6 to 8). Preferably, the sealing station 14 comprises at least one sealing head 22 operatively active on the two lateral faces 5, 6 defining the edge V1 of the package 1 equipped with the notch 9.

In light of this, the head sealing 22 is divided into two half heads facing each other to make contact on both sides with the edge V1 of the package 1 and seal the zone in which the notch 9 is present.

Preferably, each half-head has a sealing profile 43 configured in a "U" shape to create a zone for sealing the edge V1, to close the notch 9 and guarantee a perfect sealing of the package 1.

In light of this, each sealing half-head is made on a surface of a corresponding shaft 44 of a pair of shafts 44 so that it is, in use, it faces the other half-head.

It should be noted that the pair of the shafts 44 are parallel to each other and positioned above the active operating section 12*a* of the transport belt 12. Moreover, the pair of shafts 44 extends transversally to the feed direction D.

Preferably, the sealing station 14 comprises means 45 for moving each shaft 44 on which is made the half head for moving each half head between a first non-operating position, away from the edge V1 of the package 1 and of non-interference with the package 1 in transit, and a second operating position, rotated relative to the previous position, for contact with and sealing the edge V1 of the package.

Preferably, these movement means 45, (for example, a motor-driven cam system) are connected to each shaft 44 through a respective lobe 46 integral with the shaft 44 and in such a way as to obtain a synchronised rotation of the shafts 44, in directions opposite each other, about respective longitudinal axes to perform the moving towards and away of the sealing half heads.

It should be noted that this structure of the sealing heads 22 and the single sealing sequence is obtained with the sealing head 22 (that is to say, the two half heads) having a width comparable to the length of the edge V1 of the package 1.

In a variant embodiment, the sealing head 22 (that is to say, the two half heads) has a width less than the length of the edge V1 of the package 1.

In light of this, the above-mentioned movement means 45 are also configured for translating each shaft 44 along its longitudinal axis and transversally to the feed direction D.

This movement of the shafts 44 results in a sealing in two separate sub-steps, in which:

- the shafts 44 rotate and the half heads perform a first sealing of the edge V1, that is, a part of the central zone of the notch 9 and one of the lateral zones of the notch;
- the shafts 44 rotate in the opposite direction and the half heads move away from the edge V1 and, subsequently, the shafts 44 translate transversely moving the position of the half heads;
- the shafts 44 rotate again and the half heads perform a second sealing of the edge V1, that is, another part of the central zone of the notch 9 and the other lateral zone of the notch 9.

It should be noted that during the second sealing, the half heads perform a partial sealing overlapping on the previous central zone already sealed.

Alternatively, the shafts 44 do not transfer and the sealing station 14 comprises pushing means which act on the packages 1 for transferring the packages 1 transversely to the feed direction D, thus obtaining an equivalent relative movement between the sealing head 22 and the edge V1 to perform the sealing in two different sub-steps.

In the embodiment illustrated, again by way of example, four half heads are made on each of the shafts to form four sealing heads 22.

According to an alternative embodiment, the sealing station comprises lateral sealing means, so as to seal at the sides of the notch 9, and central sealing means so as to seal the notch 9.

The central sealing means are located downstream of the lateral sealing means.

Figure 12:
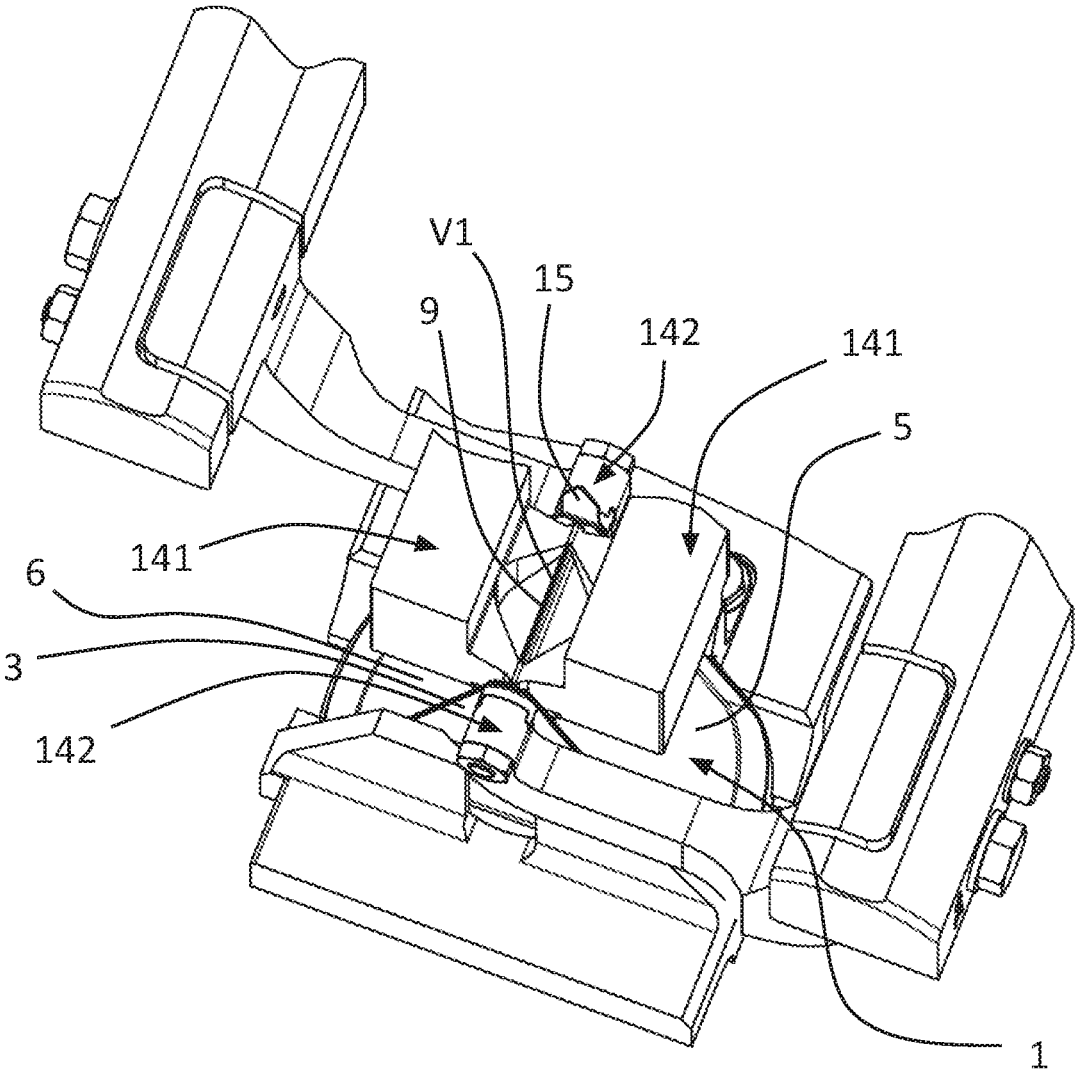
FIG. 12 illustrates a detail of the station for sealing the package in accordance with an alternative embodiment of this invention.

In the example illustrated, the lateral sealing means, shown in detail in FIG. 12, comprise a pair of U-shaped sealing heads 141 which face the lateral faces 5 and 6 with interposed the edge V1 of the container 1 for sealing at the sides of the notch 9 along the edge V1 without striking the notch 9.

In order to obtain an optimum sealing at the sides of the notch 9, a pair of abutment walls 142 are positioned against the upper face 2 and lower face 3 of the container 1, respectively, when the sealing heads 141 perform the sealing at the sides of the notch 9, in such a way that the sealing heads 141 come into contact with the abutment walls 142.

The central sealing means comprise sealing heads 141 configured for sealing the opening along the edge V1 located centrally. The central sealing means are equivalent to those described in the previous embodiment. The length of the edge V1 struck by the central sealing means is such as to strike at least partly the zones sealed previously with the lateral sealing means.

Preferably, the sealing station 14 comprises means 21 for pushing both sides operating on the upper 2 and lower 3 face or on the lateral faces of the open package 1 which are capable of obtaining an expulsion of air through the opening of the edge V1 of the package 1 before its sealing.

In the configuration in which the upper and lower faces are acted on we have as follows:

the pushing means 21 comprise a pair of pushing arms 47 positioned on opposite sides of the housing cradle 24 when the cradle 24 is in transit through the sealing station 14 (see FIGS. 3 and from 6 to 8).

Each arm 47 comprises a vertical segment 48 positioned, in use, facing the channel 24*c* (vertical) present on the cradle 24.

Each vertical segment 48 is equipped with a pushing pin 49 connected to, and protruding from, the lower end of the vertical segment 48.

Moreover, each arm 47 comprises a further segment 50 for connecting between the vertical segment 48 and a corresponding supporting shaft 51 located above the operating section 12*a* of the belt 12.

The pair of shafts 51, supporting the arms 47, extend transversally to the feed direction D and are positioned parallel to the shafts 44 with sealing heads 22, but not interfering with them.

Each shaft 51 is connected to movement means 51*a* (schematically illustrated with a block) which are able transfer the arms 51 and, consequently, the arms 47 transversally to the feed direction D (in both directions) between a first non-operating end position, wherein the vertical segments 48 are moved away from the package 1 and from the cradle 24 (position of non-interference), to a second end operating position, wherein the vertical segments 48 are moved towards the package 1, engaging the central channels 24*c* present on the walls 24*b* of the cradle 24, and the corresponding pins 49 press against the upper 2 and lower 3 face of the package 1, generating a thrust which is able to expel the air through the opening present on the edge V1 of the package 1.

It should be noted that the transfer movement between each pair of arms 47 is in opposite directions to obtain a simultaneous thrust on the two faces 2 and 3 of the package 1.

In the solution illustrated, again by way of example, on each of the supporting shafts 51 are connected four pushing arms 47 (in homogeneous groups of arms for one or the other face 2 or 3 of the package 1).

Downstream of the sealing station 14 there is the station 16 for folding and adhesion of the above-mentioned tab 15 on the edge V1 of the open and sealed package 1.

This folding and adhesion station 16 comprises a pressing element 52 made on the shaft 53 positioned above the operating section 12*a* of the belt 12.

It should be noted that the shaft 53 is positioned transversally to the feed direction D.

Preferably, the pressing element 52 is composed of a heating head projecting towards the operating section 12*a* of the belt 12.

Figure 9:
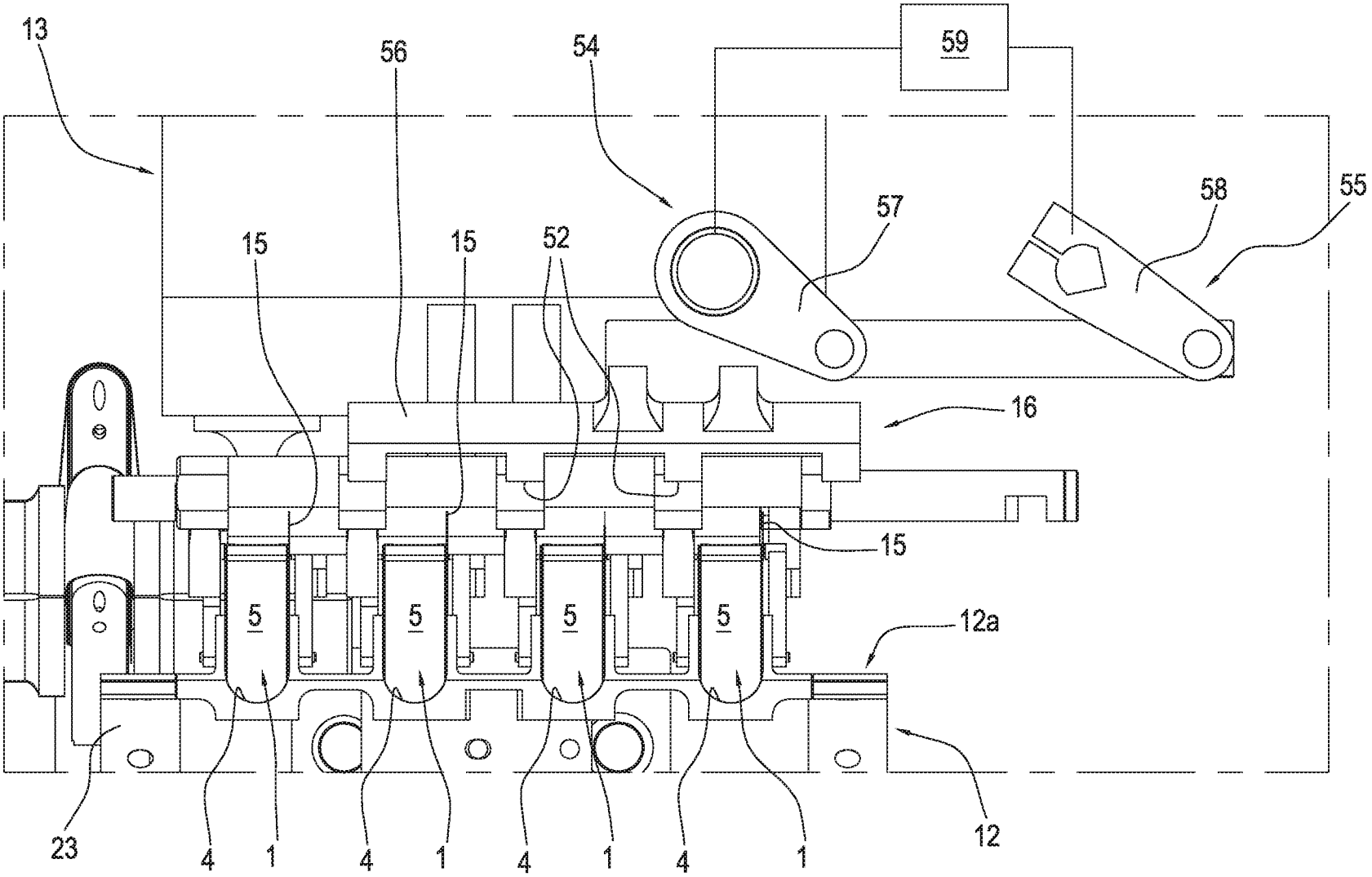
FIGS. 9 and 10 both illustrate a schematic front view of a station for folding and adhesion of a tab of the package in two different operating configurations.
Figure 10:
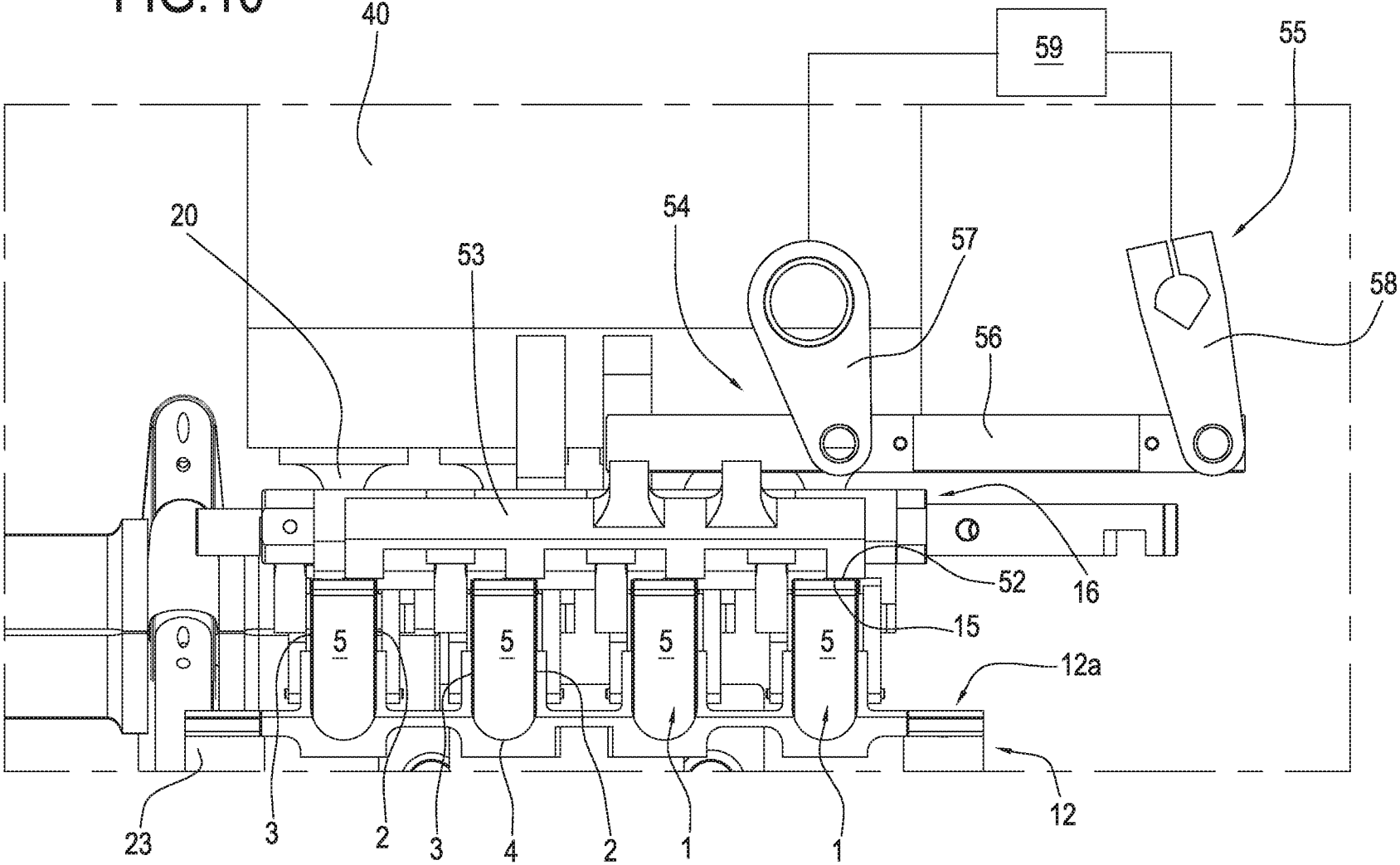

In light of this, the folding and adhesion station 16 comprises means 54 for moving the shaft 53 with the heating head to move the shaft 53 and the heating head according to a trajectory which can intercept, fold and seal the tab 15 on the edge V1 of the package 1 (see FIGS. 3, 9 and 10).

Preferably, these movement means 54 are configured for moving the shaft 53 with the heating head according to a rectilinear, or arcuate, trajectory to move the heating head from a withdrawn and raised non-operating position to an advanced and lowered operating position (lowering to a height close to the edge V1 of the package 1) in such a way as to intercept and fold the tab 15 towards the edge V1.

The heating head therefore allows a stable adhesion of the tab 15 to the portion of edge V1 on which it is superposed.

Preferably, the movement means 54 comprise, for example, a four-bar linkage unit 55 composed of a rod 56 connected to the shaft 53 and parallel to the shaft 53. The rod 56 is in turn articulated in two different points to corresponding connecting rods 57 or 58 in turn articulated to motor-driven means 59 here illustrated as a block (see FIGS. 9 and 10).

The packages 1 obtained in this way are made to further advance from the transport belt 23 to a predetermined zone for expulsion of the packages 1 towards packaging or storage stations (not illustrated).

Preferably, the packages 1 are evacuated in a zone along a non-operational section of the belt 23 downstream of the folding and adhesion station 16.

Preferably, the evacuating step comprises a simultaneous release of the packages 1 obtained and forming one row on the belt 23 with a rotation of 90° along an expulsion chute (not illustrated).

A suitable control system rejects the packages not considered compliant with the required specifications.

This invention provides a process for making packages 1 containing products, preferably liquid or creamy food products, described up to now.

According to the invention, the process comprises the following steps:

- forming, by punching, a first flat blank S1 defining the upper face 2, the lower face 3 and the rear face 4 of the open package 1 (FIG. 11);
- forming, by punching and creasing, a second flat blank S2 defining the first 5 and the second 6 lateral face of the package 1, when the package 1 is opened; the second blank S2 having at least one notch, or slot, or slit, 9 of partial transversal separation between the first 5 and the face 6 second lateral (FIG. 11);
- assembling the first blank S1 with the second blank S2 with the notch 9 of the two lateral faces 5 and 6, positioned in the shape of a 'V', on the (forming the) edge V1 of the open package 1 (FIG. 11*a*);
- preparing the open package 1 along a feed direction D, advantageously with the edge V1 of the open package 1 positioned perpendicularly to the feed direction D (FIG. 11*b*), or alternatively parallel to the feed direction D;
- opening by deforming, advantageously by flattening the edge V1 of the open package 1 so as to form to a passage zone inside the package 1 (FIG. 11*c*);
- filling the package 1 with a dose of product through the passage zone on the edge V1 of the open package 1 (FIG. 11*c*);
- sealing the edge V1 of the package 1 for completely closing the package 1 (FIG. 11*e*).

Preferably, the method comprises a step for folding the tab 15 towards the edge V1 of the package 1 and adhesion of the tab 15 on the edge V1 of the package 1 (FIG. 11*e*).

In light of this, the folding and adhesion step of the tab 15 is performed after the sealing step.

Preferably, the process comprises a step of pushing on the lateral faces or on the upper 2 and lower 3 faces of the open package 1 in opposite directions to achieve a flattening of the package 1 and a expulsion of air from the inside of the package 1 through the opening on the edge V1 of the package 1 (FIG. 11*d*).

It should be noted that this pushing step is performed before the sealing step.

Preferably, if the sealing head 22 has a width comparable to the length of the edge V1 of the package 1, the step of sealing the edge V1 of the open package 1 is obtained in a single step of contact between the sealing head 22 and the edge V1 of the package 1.

Alternatively, if the sealing head 22 has a width less than the length of the edge V1 of the package 1, the step of sealing the edge V1 of the package 1 is obtained in a first sub-step of contact between the sealing head 22 and a first stretch of the edge V1 of the package 1 and a second sub-step of contact between the sealing head 22 and a second stretch, different from the first, of the edge V1 of the package 1.

In this alternative embodiment, the step of sealing the edge V1 of the package 1 comprises a sub-step of relative movement, along a direction perpendicular to the feed direction D, of the edge V1 of the package 1 and the sealing head 22. More specifically, after the first contact sub-step, the method advantageously comprises performing the sub-step of relative movement between the edge V1 of the package 1 and the sealing head 22. Advantageously, this movement sub-step comprises applying a force on one or on the other of the upper 2 and lower 3 face, so as to move at least the edge V1 perpendicularly to the feed direction D, the sealing head 22 remaining stationary in the open position to allow the edge V1 to move. Once the edge V1 has been moved, the sealing head 22 can be closed to seal the second stretch of the edge V1 of the package 1.

According to an alternative embodiment, the step of sealing the edge V1 of the package 1 comprises a lateral sealing step in which the sealing of only the sides of the notch 9 is performed along the edge 1, close to the upper face 2 and the lower face 3, respectively, of the container 1, and a central sealing step in which the entire notch 9 along the edge V1 is sealed.

In the lateral sealing step use is made of a pair of U-shaped sealing heads 141 and a pair of abutment walls 142 positioned against the upper face 2 and lower face 3 of the container 1, respectively, in such a way that the sealing heads 141 come into contact with the abutment walls 142.

The invention claimed is:

1. A machine for making packages containing liquid or creamy products, the package being prismatic triangular in shape, when formed, and having an upper face and a lower face opposite to the upper face which are triangular in shape, a rear face and a first and second lateral face for joining and connecting the upper and lower faces; the machine comprising:

a station for punching and forming a first flat blank in a single sheet defining the upper face, the lower face and the rear face of the package when the package is formed;

a station for punching and creasing for formation of a second flat blank in a single sheet defining the first and the second lateral face of the package, when the package is formed; the second blank having at least one cut of partial transversal separation between the first and the second lateral face;

an assembly station for assembling the first blank with the second blank to form the package in a closed condition with the at least one cut between the first and the second lateral face, positioned along an edge of the package when formed;

a transport unit, movable along a feed direction, and configured to move the package from the assembly station along an operating section;

an opening and filling station forming along the edge an edge opening of the package by distancing the first and the second lateral faces at the cut along the edge and filling the package a dose of a product through the edge opening of the package; the opening and filling station being positioned along the operating section of the transport unit;

a sealing station for sealing the edge opening of the package; the sealing station being positioned downstream of the opening and filling station with respect to the feed direction.

2. The machine according to claim 1, wherein one of the upper or lower faces has a tab protruding from the edge of the package, and wherein the machine comprises a station for folding and adhesion of the tab on the edge of the package formed and sealed; the station for folding and adhesion being located downstream of the sealing station relative to the feed direction.

3. The machine according to claim 1, and further comprising an intermediate station for composing a row of formed packages, placed side by side in a direction transversal to the feed direction and formed from the assembly station; the intermediate station being interposed between the assembly station and the transport unit and configured for receiving from the assembly station individual formed packages and releasing a row of formed packages to the transport unit.

4. The machine according to claim 1, wherein the opening and filling station comprises a pressing member configured to press the package on both the upper and lower faces in order to elastically deform the edge of the package and form the edge opening along the edge for passage of the dose of the product.

5. The machine according to claim 1, wherein the opening and filling station comprises a feed unit having at least one nozzle for dosing the dose of the product; the at least one nozzle being movable, along a vertical axis between a first lowered end operating position, wherein the nozzle is positioned inside the package and passing through the edge opening, and a second raised end non-operating position, wherein the nozzle is positioned above the package in a configuration of non-interference with the package.

6. The machine according to claim 1, wherein the sealing station comprises a pushing member configured to push on the lateral faces or on both the upper and lower faces of the package in order to expel air through the edge opening before the package is sealed.

7. The machine according to claim 1, wherein the sealing station comprises a lateral sealing member configured to seal at opposite sides of the edge opening, and a central sealing member configured to seal the edge opening at a central position between the opposite sealed sides, the lateral sealing member comprising a pair of sealing heads facing the first and second lateral faces of the package with the edge opening therebetween.

8. The machine according to claim 7, wherein the lateral sealing member further comprises a pair of abutment walls configured to be actuated so as to be positioned against the upper face and lower face of the package, respectively, when the pair of sealing heads performs the sealing at the opposite sides of the edge opening, in such a way that the pair of sealing heads comes into contact with the abutment walls.

9. The machine according to claim 1, comprising a transfer member positioned between the assembly station and the transport unit; the transfer member comprising a first device including an actuator for transferring an individual package formed by the assembly station to an intermediate station which forms a row of packages, and a second device including at least one gripper for simultaneously transferring a plurality of packages of the formed row, from the intermediate station to the transport unit.

10. A process for making packages containing liquid or creamy products, the package being prismatic triangular in shape, when formed, and having an upper face and a lower face opposite to the upper face which are triangular in shape, a rear face and a first and second lateral face for joining and connecting the upper and lower faces, wherein the process comprises the following steps:

forming, by punching, a first flat blank in a single sheet defining the upper face, the lower face and the rear face when the package is formed;

forming, by punching and creasing, a second flat blank in a single sheet defining the first and the second lateral face of the package, when the package is formed; the second blank having at least one cut of partial transversal separation between the first and the second lateral face;

assembling the first blank with the second blank to form the package, with the at least one cut between the first and the second lateral face, positioned along an edge of the package when formed;

after assembling, using a transport unit movable along a feed direction and configured to receive the package to move the package along the feed direction along an operating section;

opening the package by distancing the first and the second lateral face at the cut along the edge so as to form an edge opening of the package;

filling the package with a dose of product through the edge opening of the package, both the opening and the filling occurring along the operating section; and sealing the edge opening for fully closing the package.

11. The process according to claim 10, wherein one of the upper and lower faces has a tab protruding from the edge of the package, and further comprising a step of folding and adhesion of the tab on the edge of the package formed and sealed; the step for folding and adhesion of the tab being performed after the sealing step.

12. The process according to claim 10, and further comprising a step of pushing on the lateral faces or on the upper and lower faces of the package in opposite directions for squeezing the package to expel air from inside of the package through the edge opening of the package; the pushing step being performed before the sealing step.

13. The process according to claim 10, wherein the step of sealing the edge of the package is obtained in a single step of contact between a sealing head and the edge of the package, and wherein the sealing head has a width comparable with a length of the edge of the package.

14. The process according to claim 10, wherein the step of sealing the edge of the package is obtained in a first sub-step of contact between a sealing head and a first stretch of the edge of the package and a second sub-step of contact between the sealing head and a second stretch of the edge of the package different from the first stretch, and wherein the sealing head has a width less than a length of the edge of the package.

15. The process according to claim 14, wherein the step of sealing the edge of the package comprises a sub-step of causing relative movement along a direction perpendicular to the feed direction between the edge of the package and the sealing head.

16. The process according to claim 10, comprising a step of pressing the package on both the upper and lower faces to elastically deform the edge of the package in order to form the edge opening along the edge for passage of the dose of the product.

* * * * *